United States Patent [19]

Kouchi et al.

[11] 4,415,645

[45] Nov. 15, 1983

[54] DEVELOPER FOR ELECTROPHOTOGRAPHY AND PROCESS FOR PREPARATION THEREOF

[75] Inventors: Toshihiro Kouchi, Hirakata; Tatsuo Aizawa, Osaka, both of Japan

[73] Assignee: Mita Industrial Company Limited, Osaka, Japan

[21] Appl. No.: 17,804

[22] Filed: Mar. 5, 1979

[30] Foreign Application Priority Data

Mar. 10, 1978 [JP] Japan ..... 53/26518

[51] Int. Cl.[3] ..... G03G 9/06

[52] U.S. Cl. ..... 430/107; 430/111; 430/903

[58] Field of Search ..... 430/107, 110, 111, 903, 430/106.6

[56] References Cited

U.S. PATENT DOCUMENTS 3,338,991 8/1967 Insalaco et al. ..... 430/137
3,345,294 10/1967 Cooper ..... 430/903
3,893,932 7/1975 Azar et al. ..... 430/111
3,997,488 12/1976 Tsubuko et al. ..... 430/137
4,016,099 4/1977 Wellman et al. ..... 430/111

*Primary Examiner*—John E. Kittle
*Assistant Examiner*—John L. Goodrow
*Attorney, Agent, or Firm*—Sherman & Shalloway

[57] ABSTRACT

A particulate composite developer for electrophotography is disclosed, which has a novel dispersion structure comprising a continuous phase consisting of a homogeneous mixture of a resin and a pigment and a dispersed phase consisting of spherical particles of a soft parting or fixing material having an emulsion grade size and being dispersed in the continuous phase. This particulate developer has in combination improved adaptability to the developing operation, excellent transferring and cleaning properties, good ability to form a sharp image free of fog and good fixing property not causing an offset phenomenon.

8 Claims, 1 Drawing Figure

DEVELOPER FOR ELECTROPHOTOGRAPHY AND PROCESS FOR PREPARATION THEREOF

BACKGROUND OF THE INVENTION (1) Field of the Invention

The present invention relates to a developer for electrophotography and a process for the preparation thereof. More particularly, the invention relates to a developer for electrophotography having an improved adaptability to the developing operation, being excellent in transferring and cleaning properties, being capable of forming an image free of fog and having a good fixing property without causing an offset phenomenon, especially a composite magnetic developer having such excellent characteristics, and also to a process for the preparation thereof.

Furthermore, the present invention relates to a novel process in which a developer for electrophotography, especially a composite magnetic developer, having the above-mentioned excellent characteristics, can be prepared by a small number of steps at a high operation efficiency with various advantages.

(2) Description of the Prior Art

As one of the methods for developing electrostatic latent images formed by the electrostatic photographic process, there is widely adopted a so-called magnetic brush method. According to the early magnetic brush development method, a developer formed by mixing toner particles comprising a pigment and a resin binder imparting the fixing property and desirable electric characteristics to the pigment with a magnetic carrier such as iron powder is used, and an electrostatic latent image-carrying surface of a support is intimately contacted with a magnetic brush of this developer to visualize the electrostatic latent image with the toner particles. In this method using a mixture of the toner and magnetic carrier, however, while the developing operation is carried out, only the toner particles are consumed in the mixture, and therefore, the mixing ratio of the toner to the magnetic carrier is changed. Accordingly, in order to maintain a good balance between the toner and magnetic carrier, it is necessary to frequently supply the toner into the mixture in a copying machine during the operation.

A so-called magnetic developer is known as a developer capable of performing the development singly without the aid of a magnetic carrier. Magnetic developers customarily used are ordinarily prepared by dispersing a powdery magnetic material such as powdery triiron tetroxide, $Fe_3O_4$ together with other pigment according to need, in a binder resin medium, forming the dispersion into granules and embedding or holding a conducting substance such as carbon black on surfaces of the granules, whereby the entire particles are rendered magnetically attractable and the surfaces of the particles are rendered electrically conductive.

We previously found that particles formed by spraying a liquid dispersion comprising a binder resin medium and a fine powder of a magnetic material into a drying atmosphere have fine convexities and concavities on the outer surfaces thereof, namely crater-like surfaces, and that when these particles are dry-blended with an electrically conductive fine powder such as carbon black, there can be obtained a developer having much improved conductivity and flowability. Based on this finding, we proposed a novel one-component type developer (see Japanese Patent Application Laid-Open Specification No. 52639/77).

This developer is very excellent in the adaptability to the developing operation and is valuable for attaining an object of obtaining a clear image free of bleeding in contours. However, a further improvement is desired when this developer is used in the reproduction process in which a developer image formed on a photosensitive layer for electrophotography is transferred onto a transfer sheet and the photosensitive layer is used repeatedly for reproduction. Especially when a soft binder is incorporated into the developer so as to enable pressure fixation or a soft parting agent is incorporated so as to prevent occurrence of an offset phenomenon, some defects arise.

More specifically, such developer particles are ordinarily low in the efficiency of transfer from a photosensitive plate to a transfer sheet, and in the repeated reproduction process, it is often difficult to completely clean away the developer particles remaining on the surface of the photosensitive plate. The most serious defect in the developer of this type is that a soft binder or parting agent contained in the developer particles is transferred to the surface of a photosensitive plate and is gradually accumulated thereon to form an electrically insulating layer on the surface of the photosensitive plate. Accordingly, when this developer is employed, even if the photosensitive plate is used repeatedly a small number of times, fogging in prints or electric breakdown on the photosensitive plate is caused by the residual voltage, resulting in extreme shortening of the life of the photosensitive plate.

A so-called microcapsulated developer prepared by forming a shell of a hard component such as a resin on the surface of a core composed of a soft component such as wax, a magnetic material, a pigment and the like is known. This microcapsulated developer, however, is defective in that since the electric resistance of the particles per se is extremely high, fogging is readily caused and it is difficult to form a sharp image. In order to eliminate this defect, it is necessary to render the particles electrically conductive, and for this purpose, the particles should be dry-blended with a large amount of carbon black. As a result, the surface of a photosensitive plate is gradually contaminated with free carbon black or an optical system or corona discharge mechanism of a copying machine is often contaminated by free carbon scattered around. In such microcapsulated developer, utilization of the soft parting or fixing material contained in the core is less sufficient than in the ordinary uncapsulated developer, and therefore, the microcapsulated developer is relatively insufficient in the offset-preventing property and adaptability to pressure fixation. Furthermore, in production of such microcapsulated developer, in order to distribute the soft component in the core and the hard component in the shell, it is necessary to adopt troublesome operations and select strictly the process conditions for formation of developer particles, and therefore, the manufacturing cost is inevitably increased.

SUMMARY OF THE INVENTION

We noted that if a material which is insoluble in cold toluene but is soluble in hot toluene is used as a soft parting or fixing material by utilizing this difference of the solubility, it is possible to granulate the material into spherical particles having an emulsion grade particle size very easily. As a result of researches, we finally found that when a composition comprising the above-mentioned spherical particles, a resin dissolved in cold toluene and pigment particles is spray-dried and granulated, there can be obtained a particulate developer having a novel dispersion mode which comprises a dispersed phase consisting of the above-mentioned particles and a continuous phase consisting of a homogeneous mixture of the resin and pigment particles, and that the so formed particulate developer is very excellent in the above-mentioned various properties. Based on this finding, we have now completed the present invention.

It is therefore a primary object of the present invention to provide a composite developer for electrophotography which has in combination improved adaptability to the developing operation, excellent transferring and cleaning properties, good ability to form a sharp image free of fog and good fixing property not causing an offset phenomenon, and a process for the preparation of such developer.

Another object of the present invention is to provide a composite developer for electrophotography which has a novel dispersion structure comprising a continuous phase consisting of a homogeneous mixture of a resin and a pigment and a dispersed phase consisting of spherical particles of a soft parting or fixing material having an emulsion grade size and being dispersed in the continuous phase, and a process for the preparation of such developer.

Still another object of the present invention is to provide a process in which a composite developer having the above-mentioned dispersion structure and excellent characteristics can be prepared by a small number of steps very easily without adoption of troublesome operations or strict process conditions.

In accordance with the present invention, there is provided a developer for electrophotography consisting of particles having a dispersed phase consisting of substantially spherical particles having a particle size not larger than 10μ and being composed substantially of a soft parting or fixing material insoluble in cold toluene but soluble in hot toluene and a continuous phase consisting of a mixture of a resin soluble in cold toluene and at least one pigment selected from the group consisting of coloring pigments, extender pigments, magnetic pigments and electrically conductive pigments, wherein said parting or fixing material (A) and said resin (B) are present at an (A)/(B) weight ratio of from 95/5 to 55/45.

The present invention will now be described in detail.

DETAILED DESCRIPTION OF THE PREFERRED EMBODIMENTS

[Structure of Developer Particles]

Figure 1:
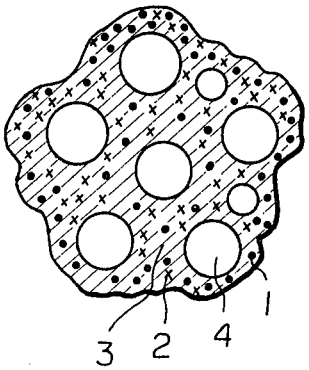
FIG. 1 is a view illustrating diagrammatically the sectional structure of an instance of the developer according to the present invention.

Referring to FIG. 1 illustrating diagrammatically the sectional structure of a particle of the developer of the present invention, the developer particle comprises a continuous phase consisting of a mixture of pigment and dye such as a magnetic pigment 1 and an electrically conductive pigment 2 and a resin 3 soluble in cold toluene, and a dispersed phase consisting of substantially spherical particles 4 composed mainly of a soft parting or fixing material insoluble in cold toluene but soluble in hot toluene and having an emulsion grade size, ordinarily not larger than 10μ, especially not larger than 5μ but not smaller than 0.1μ.

In other words, the particulate developer of the present invention has a specific structure in which a plurality of emulsion grade size particles 4 of the soft parting or fixing material are capsulated as cores with the resin layer 3 containing the pigments 2 and 3. In this continuous phase, the pigments may be homogeneously distributed in the resin throughout the continuous phase, but in the case where a magnetic pigment 1 is included as the pigment, since the above-mentioned spray granulation method is adopted and a great number of emulsion grade size particles are present in the interior as nuclei or cores, the magnetic pigment 1 is distributed predominantly in the surface portion.

In the particulate developer of the present invention, the soft parting or fixing material forms the dispersed phase of particles 4 having an emulsion grade size and a homogeneous mixture of the pigment and resin forms the continuous phase, and a number of the particles 4 of the dispersed phase are capsulated with this homogeneous mixture of the continuous phase. More specifically, the soft parting or fixing material is protected by the pigment-resin mixture so that cohesion of the particles of the soft parting or fixing material or blocking thereof is not caused to occur, and at the step of fixing the developed image, the capsulated soft parting or fixing material easily oozes out through the pigment-resin mixture, whereby occurrence of the offset phenomenon is prevented or a good fixing property is given to the developer particles. Furthermore, in case of a one-component type developer where an electrically conductive pigment is used as at least a part of the pigment of the continuous phase, by virtue of the above-mentioned specific dispersion structure of the particulate developer, there can be attained an effect of improving the electric conductivity of developer particles remarkably. Also in case of a two-component type developer, there can be attained an effect of controlling the charge of developer particles to one specific polarity at a high level. Accordingly, the developer of the present invention is prominently excellent in the flowability over the conventional particulate developer in which a hard resin and a soft parting or fixing material are present in the state where they are dissolved in each other, and therefore, in the developer of the present invention, the tendency of developer particles to cohere or block is remarkably reduced even during the developing operation or when the temperature is elevated. Moreover, migration of the fixing material to the photosensitive plate is substantially prevented and shortening of the life of the photosensitive plate can be effectively prevented. Still further, the particulate developer of the present invention is prominently excellent in the fixing property over the conventional capsulated developer in which a single core of a parting or fixing material and a pigment is capsulated with a hard resin, and the developer of the present invention is able to form an image of a high density with a much reduced edge effect. Still in addition, the developer of the present invention is excellent in the transferability of developer particles and the adaptability to cleaning-off of developer particles remaining on the photosensitive plate. As will be apparent from the foregoing, various advantages and effects can be attained by the particulate developer of the present invention having the above-mentioned dispersion structure.

[Components of Developer]

Most of soft parting and fixing materials are insoluble in cold toluene but soluble in hot toluene, and this specific solubility characteristic is skillfully utilized in the present invention. More specifically, a hot solution of a soft parting or fixing material having such solubility characteristic is cooled to form an emulsion of the soft parting or fixing material, and the soft parting or fixing material is incorporated in the form of the emulsion particles thus prepared.

All of soft parting and fixing materials having the above-mentioned solubility characteristic can be used in the present invention. A low-molecular-weight olefin type polymer having a penetration of 1 to 50, especially 3 to 25, as measured at 25° C. according to ASTM D 1321-55T. is particularly preferred as such soft parting or fixing material.

As the low-molecular-weight olefin type polymer, there can be mentioned, for example, homopolymers and copolymers of olefins represented by the following formula and modification products thereof:

$$CH_2{=}\underset{\underset{R}{|}}{CH}$$

wherein R stands for a hydrogen atom or an alkyl group having up to 4 carbon atoms, such as polyethylene, polypropylene, α-polybutylene, β-polybutylene, ethylene-propylene copolymers, polyethylene wax, oxidized polyethylene, chlorination products thereof, and random, block and graft copolymers composed mainly of ethylene or propylene and modified with at least one member selected from ethylenically unsaturated monomers such as vinyl acetate, maleic anhydride, acrylic acid, acrylic acid esters, methacrylic acid, methacrylic acid esters, acrylamide, methacrylamide, acrylonitrile and methacrylonitrile. Among these polymeric materials, those having a low molecular weight are used in the present invention. From the viewpoints of the fixing property and adaptability to the fixing operation, it is preferred that the molecular weight of such olefin type polymer be 500 to 10,000, especially 700 to 5,000.

As another instance of the soft parting or fixing material, there can be mentioned waxes having a penetration of 1 to 50 as measured at 25° C., for example, naturally occurring waxes such as vegetable waxes, animal waxes, solid fats and mineral waxes and synthetic waxes such as higher fatty acids and derivatives thereof. These waxes may be used singly or in combination with a low-molecular-weight olefin type polymer as mentioned above.

Examples of waxes that are preferably used in the present invention are described below, though waxes that can be used in the present invention are not limited to these waxes.

Waxes in narrow sense:

Carnauba wax, cotton wax, candelilla wax, cane wax, bees wax, sperm wax, shellac wax, wool wax, etc.

Mineral and petroleum waxes:

Montan wax, paraffin wax, microcrystalline wax, etc.

Solid higher fatty acids having 6 to 22 carbon atoms:

Palmitic acid, stearic acid, hydroxystearic acid, behenic acid, etc. Higher fatty acid amides having 6 to 22 carbon atoms (by the term "higher" used hereinafter is meant "having 6 to 22 carbon atoms"):

Oleic acid amide, stearic acid amide, palmitic acid amide, N-hydroxyethyl-hydroxystearoamide, N,N'-ethylene-bis-stearoamide, N,N'-ethylene-bis-ricinolamide, N,N'-ethylene-bis-hydroxystearylamide, etc. Alkali metal, alkaline earth metal, zinc and aluminum salts of higher fatty acids:

Calcium stearate, aluminum stearate, magnesium stearate, calcium palmitate, etc.

Hydrazides of higher fatty acids:

Palmitic acid hydrazide, stearic acid hydrazide, etc.

p-Hydroxyanilides of higher fatty acids:

Myristyric acid p-hydroxyanilide, stearic acid p-hydroxyanilide, etc. β-Diethylaminoethyl ester hydrochlorides of higher fatty acids:

β-Diethylaminoethyl laurate hydrochloride, β-diethylaminoethyl stearate hydrochloride, etc.

Higher fatty acidamide-formaldehyde condensates:

Stearic acid amide-formaldehyde condensate, palmitic acid amide-formaldehyde condensate, etc.

Petroleum residues:

Asphalt, gilsonite, etc.

Rubbers:

Nitrile rubber, chlorinated rubber, etc.

Synthetic hydrocarbons:

Fisher-Tropsch wax, its derivatives, etc.

Fatty acid esters and glycerides:

Polyethylene glycol, sorbitol stearate, etc.

Halogenated hydrocarbons:

Chlorinated paraffin, chlorinated propylene, etc.

Hardened oils:

Hardened castor oil, hardened beef tallow oil, etc.

When the developer is applied to the fixing method where fixing is carried out by using a heating roller or press roller, if such wax alone is used as the soft parting or fixing material, an offset phenomenon is readily caused. Accordingly, in this case, it is preferred that the wax be used in combination with a low-molecular-weight olefin type polymer as mentioned above in an amount of up to 80% by weight, especially up to 70% by weight, based on the olefin type polymer.

Any of hard resins soluble in cold toluene can be used as the resin forming the continuous phase in the present invention.

As the hard resin, there are preferably employed known natural, semi-synthetic and synthetic resins having a penetration lower than 1 as measured at 25° C. according to ASTM D 1321-55T. These hard resins may be thermoplastic resins or uncured thermosetting resins or precondensates thereof. As valuable natural resins, there can be mentioned, for example, balsam, rosin, shellac and copal resins, and these natural resins may be modified with at least one member selected from vinyl resins, acrylic resins, alkyd resins, phenolic resins, epoxy resins and oleoresins, such as described hereinafter. As synthetic resins that can be used in the present invention, there can be mentioned, for example, vinyl resins such as vinyl chloride-vinyl acetate copolymer resins, vinylidene chloride resins, vinyl acetate resins, vinyl acetal resins, e.g., polyvinyl butyral, and vinyl ether polymers, acrylic resins such as polyacrylic acid esters, polymethacrylic acid esters, acrylic acid copolymers and methacrylic acid copolymers, styrene resins such as polystyrene and styrene copolymers, polyamide resins such as polymerized fatty acid-modified polyamides, polyesters such as polyethylene terephthalate/isophthalate/adipate and polytetraethylene terephthalate/isophthalate/adipate, alkyd resins such as phthalic resins and maleic resins, phenol-formaldehyde resins, ketone resins, coumarone-indene resins, amino resins such as urea-formaldehyde resins and melamine-formaldehyde resins, and epoxy resins. These synthetic resins may be used in the form of a mixture of two or more of them, for example, a mixture of a phenolic resin and an epoxy resin or a mixture of an amino resin and an epoxy resin.

In the present invention, it is important that the parting or fixing material (A) and the above-mentioned resin (B) should be used at an (A)/(B) weight ratio of from 95/5 to 55/45, especially from 90/10 to 60/40. When the amount of the parting or fixing material (A) is smaller than defined by the above range, a satisfactory offset-preventing effect or satisfactory fixing property cannot be attained at the fixing step, and when the amount of the parting or fixing material (A) is larger than defined by the above range, there are brought about such disadvantages as increased cohesion of developer particles, reduction of flowability of developer particles, shortening of the life of a photosensitive plate and degradation of a carrier.

In the present invention, at least one member selected from coloring pigments, extender pigments, magnetic pigments and electrically conductive pigments is used as the pigment. Of course, pigments having at least two of the above-mentioned functions can be used. For example, carbon black having a function as a black pigment and a function as an electrically conductive pigment and (triiron tetroxide) having a function as a magnetic pigment and a function as a black pigment, as seen from its other name "black iron", can be used in the present invention.

Suitable examples of the coloring pigment that can be used in the present invention are as follows:

Black Pigments:

Carbon black, acetylene black, lamp black and aniline black.

Yellow Pigments:

Chrome yellow, zinc yellow, cadmium yellow, yellow iron oxide, Mineral Fast Yellow, nickel titanium yellow, naples yellow, Naphthol Yellow S, Hansa Yellow G, Hansa Yellow 10G, Benzidine Yellow G, Benzidine Yellow GR, Quinoline Yellow Lake, Permanent Yellow NCG and Tartrazine Lake.

Orange Pigments:

Chrome orange, molybdenum orange, Permanent Orange GTR, Pyrazolone Orange, Vulcan Orange, Indanthrene Brilliant Orange RK, Benzidine Orange G, Indanthrene Brilliant Orange GK.

Red Pigments:

Red iron oxide, cadmium red, red lead, mercury sulfide, cadmium, Permanent Red 4R, Lithol Red, Pyrazolone Red, Watchung Red calcium salt, Lake Red D, Brilliant Carmine 6B, Eosine Lake, Rhodamine Lake B, Alizarine Lake and Brilliant Carmine 3B.

Violet Pigments:

Manganese violet, Fast Violet B and Methyl Violet Lake.

Blue Pigments:

Prussian blue, cobalt blue, Alkali Blue Lake, Victoria Blue Lake, Phthalocyanine Blue, metal-free Phthalocyanine Blue, partially chlorinated Phthalocyanine Blue, Fast Sky Blue and Indanthrene Blue BC.

Green Pigments:

Chrome green, chromium oxide, Pigment Green B, Malachite Green Lake and Fanal Yellow Green G.

White Pigments:

Zinc flower, titanium oxide, antimony white and zinc sulfide.

As the extender pigment that can be used in the present invention, there can be mentioned, for example, baryte powder, barium carbonate, clay, silica, white carbon, talc and alumina white.

As the dye, there can be used, for example, basic dyes, acidic dyes, disperse dyes and direct dyes such as Nigrosine, Methylene Blue, Rose Bengale, Quinoline Yellow and Ultramarine Blue.

As the magnetic pigment, there are known triiron tetroxide ($Fe_3O_4$), ferric oxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodium iron oxide ($NdFeO_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co) and nickel powder (Ni). Any of fine powders of these known magnetic substances can be used as the magnetic pigment in the present invention. Magnetic pigments especially suitable for attaining the objects of the present invention are triiron tetroxide and ferric oxide.

As the electrically conductive pigment, there can be used any of inorganic fine powders which per se are not electrically conductive but have been rendered electrically conductive by the conducting treatment and various metal powders, in addition to the above-mentioned carbon black.

The amount of the pigment can be changed in a relatively broad range according to the intended use of the developer, but in general, the pigment is incorporated in an amount of 1 to 500% by weight based on the binder. In case of a two-component type developer, namely when the developer is used as the toner to be combined with a magnetic carrier, it is preferred that a coloring pigment be used in an amount of 1 to 15% by weight, especially 2 to 10% by weight, based on the binder (the sum of the fixing material and resin), and in case of a one-component type magnetic, electrically conductive developer, it is preferred that a magnetic pigment be used in an amount of 50 to 500% by weight, preferably 100 to 400% by weight, based on the binder. In the latter case, an electrically conductive pigment may be used in an amount of 0.1 to 20% by weight, especially 0.5 to 15% by weight, based on the binder in combination with the magnetic pigment according to need.

Known additives may be incorporated into the developer of the present invention according to known recipes. For example, in case of a two-component type developer, a known charge controlling agent or dispersant, for example, an oil-soluble dye such as Nigrosine Base (CI 5045), Oil Black (CI 26150) or Spilon Black, a metal salt of naphthaenic acid, a fatty acid metal soap, a resin acid soap or the like may be incorporated in an amount of 0.1 to 5% by weight based on the binder.

[PREPARATION OF PARTICULATE DEVELOPER]

The developer of the present invention is prepared by a process comprising forming a composition for spraying by combining the steps of cooling a high temperature solution of a parting or fixing material insoluble in cold toluene but soluble in hot toluene in a solvent under agitation to precipitate the parting or fixing material in the form of emulsion particles having a substantially spherical shape and a particle size not larger than 10$\mu$ and being composed mainly of said parting or fixing material, dissolving a resin soluble in cold toluene in said solvent and dispersing at least one pigment selected from the group consisting of coloring pigments, extender pigments, magnetic pigments and electrically conductive pigments, thereby to form a composition of the spherical particles and pigment dispersed in the resin solution; and then spraying said composition into a drying atmosphere to form developer particles.

The soft parting or fixing material is easily soluble in hot toluene at a temperature higher than 65° C., especially higher than 80° C., and when a solution of the soft parting or fixing material is cooled at room temperature or a lower temperature under agitation, emulsion particles are precipitated. As the solvent for dissolving therein the soft parting or fixing material at a higher temperature, there can be used not only the above-mentioned toluene but also aromatic solvents such as xylene, ethylbenzene, cumene, benzene and mixed aromatic solvents, and chlorine-containing solvents such as carbon tetrachloride, perchlene and trichlene. The particle size of the precipitated emulsion particles can be adjusted by controlling the cooling speed, the concentration of the solution and the degree of agitation. In the present invention, it is preferred that the concentration of the solution of the soft parting or fixing material be 5 to 30% by weight, especially 10 to 20% by weight, and the cooling speed be 1° to 100° C. per minute, especially 3° to 50° C. per minute.

As the hard resin and the solvent for dissolving therein the hard resin, there are used a solvent in which the soft parting or fixing material is insoluble in the cold state and a resin soluble in this solvent in the cold state.

The step of emulsifying the parting or fixing material, the step of dissolving the hard resin and the step of dispersing the pigment may be conducted in this order or a different order in a single system, or these steps may be conducted separately and the resulting emulsion, solution and dispersion may be mixed together.

For example, there may be adopted a method in which the parting or fixing material and hard resin are dissolved in a solvent in the hot state, the pigment is dispersed in the resulting solution, and the resulting hot dispersion-solution is cooled to room temperature to emulsify the parting or fixing material in the composition containing the dissolved hard resin and the dispersed pigment. Further, there may be adopted a method in which the hot solution is cooled to room temperature to emulsify the parting or fixing material and the pigment is dispersed in the resulting emulsion.

Furthermore, there may be adopted a method in which an emulsion of the parting or fixing material and a solution of the hard resin are prepared separately, both the liquids are combined and the pigment is dispersed in the liquid mixture. In this case, prior to mixing of the two liquids, the pigment may be dispersed in one of the two liquids.

For dispersing the pigment, there may be adopted known dispersing means such as ultrasonic irradiation, homogenizer dispersing or ball milling.

In the present invention, the solid concentration in the composition for spraying is adjusted so that the composition can be sprayed and can easily be solidified (coagulated) to spherical particles in a drying atmosphere. From this viewpoint, it is preferred that the solid concentration in the composition for spraying be 20 to 80% by weight, especially 30 to 60% by weight, and that the concentration of the resin in the composition be 1 to 30% by weight, especially 3 to 25% by weight.

Developer particles are formed by spraying the so prepared composition for spraying in a drying atmosphere.

In the present invention, as the drying atmosphere, there are employed gases such as air, nitrogen, carbon dioxide gas and combustion gas heated at 5° to 200° C. A gas fluid heated at a temperature higher than the boiling point of the solvent used is ordinarily used as the drying atmosphere. A solution of the hard binder resin containing the above-mentioned emulsified particles and dispersed pigment particles is sprayed in such drying atmosphere.

For spraying the above-mentioned composition in the drying atmosphere, there may be used various known means, for example, a one-fluid or two-fluid nozzle, a centrifugal spray nozzle consisting of a rotary member having a great number of holes formed on the circumferential wall thereof and a rotary disc. The so obtained developer particles may be dried under reduced pressure or atmospheric pressure under such conditions that the binder medium in the particles are not substantially fused, according to need. Thus, the remaining solvent is removed and the particulate developer of the present invention is obtained.

The particle size of spherical particles of the developer of the present invention is changed depending on the size of the emulsion particles, the concentration and viscosity of the composition sprayed, the spraying speed and the temperature and flow speed of the drying atmosphere. In the present invention, it is preferred that these conditions be selected so that the number average particle size of the resulting developer particles is 5 to 40μ, particularly 10 to 25μ, and that particles having a size larger than 40μ occupy less than 10% of the total particles and particles having a size smaller than 5μ occupy less than 10% of the total particles.

[POST TREATMENT]

The particlate developer of the present invention prepared according to the above-mentioned spray granulation method may be subjected to a known post treatment according to need. For example, in case of a one-component type developer, in order to improve the electric conductivity or flowability, the developer particles of the present invention are dry-blended with flowability- and electric resistance-controlling fine particles having a volume resistivity lower than $10^{13}$ Ω-cm, preferably $10^8$ to $10^{12}$ Ω-cm, and a particle size smaller than 1μ, especially smaller than 0.1μ.

As such fine particles, there can be used fine particles of carbon black, inorganic substances which per se are electrically non-conductive but subjected to a conductive treatment, and various metals.

As carbon black having a particle size smaller than 1μ and a volume resistivity lower than $10^{13}$ Ω-cm, there can be used, for example, furnace black for rubbers, channel black for batterys and rubbers and channel black for pigments. Corax L (electrically conductive carbon black manufactured by Degussa Co.) and Vulcan XC-72R (electrically conductive carbon black manufactured by Cabot Corporation) are especially preferred as the carbon black.

Moreover, fine particles of metal oxides such as triiron tetroxide, ferric oxide and dinickel trioxide and metals such as iron, cobalt, copper, silver, gold, aluminum and tin may be used as the flowability- and electic resistance-controlling fine particles. Still further, fine particles of inorganic substances such as silicon dioxide, active clay, acid clay, kaolin, alumina and zeolite, non-electrolytically plated with gold, silver, copper, nickel or the like, and fine particles of metal sulfides may be used as the flowability- and electric resistance-controlling fine particles.

As the inorganic fine particles (carrier particles) to be subjected to a conductive treatment, there may be used those disclosed in Japanese patent application Laid-Open Specification No. 52639/77.

The above-mentioned spherical developer particles (a) are dry-blended with such flowability- and electric resistance-controlling fine particles (b) at an (a)/(b) weight ratio of from 10000/1 to 50/1, preferably from 2000/1 to 100/1. When this (a)/(b) weight ratio is lower than 50/1, the absorption or holding of the fine particles onto the particles (a) becomes insufficient, the background of a copy sheet after the development is readily contaminated or the fixing property of the toner image is degraded. When the (a)/(b) weight ratio is higher than 10000/1, no particular advantage is attained by blending of the flowability- and electric resistance-controlling fine particles (b).

[USES]

The developer of the present invention can be used widely for electrophotographic reproduction and electrophotographic printing. More specifically, the developer of the present invention may be used not only as a one-component type developer not using a carrier but also as a two-component developer using a carrier such as a magnetic powder, e.g., iron powder or glass bead. The developer of the present invention is especially valuable as a so-called transfer type developer which is used in a photographic reproduction process in which an electrostatic latent image formed on a photosensitive plate for electrophotography is developed by the developer powder and the so formed powder image is transferred onto a transfer sheet.

The present invention will now be described in detail by reference to the following Examples that by no means limit the scope of the invention.

EXAMPLE 1

15 Parts by weight of low-molecular-weight polyethylene (San-Wax 131-P manufactured by Sanyo Kasei K. K.) and 85 parts by weight of toluene were heated at 80° C. and immediately after the low-molecular-weight polyethylene was completely dissolved in toluene, the solution was cooled under agitation in a cold water bath. When the temperature was lowered below 65° C., the polyethylene was recrystallized and precipitated as emulsion particles having a spherical shape and a particle size of 2 to 3 $\mu$.

A composition for spraying was prepared by completely dispersing the following components by a homogenizing mixer at room temperature:

| | |
|---|---|
| Acrylic resin (BR 107 manufactured by Mitsubishi Rayon K.K.) | 5 parts by weight |
| Above emulsion | 100 parts by weight |
| $Fe_3O_4$ (Synthetic Black Iron B6 manufactured by Toyo Shikiso) | 65 parts by weight |
| Carbon black (Corax L manufactured by Degussa Co.) | 2 parts by weight |
| Dispersant | 0.5 part by weight |

-continued

| | |
|---|---|
| Toluene | 40 parts by weight |

The so formed composition was spray-dried to effect granulation and drying, and the resulting toner was classified to collect particles having a size of 5 to 40$\mu$ as the developer.

A master having a ZnO-containing photoconductive layer was subjected to corona discharge at −5 KV image wise exposed and developed with the so formed developer. The developed image was transferred onto a plain paper at −5 KV and the transferred image was fixed under pressure by passing the paper between steel rolls. A print having an image free of fog with a high transfer efficiency was obtained. It was found that the cleaning property of the master was very good and the transfer rate of the toner image was very good. When 1000 prints were continuously formed in the above-mentioned manner, the image quality was stable in these prints and degradation of the master was not observed at all.

EXAMPLE 2

10 Parts by weight of low-molecular-weight polypropylene (Viscol 550P manufactured by Sanyo Kasei K. K.), 10 parts by weight of microcrystalline wax (Wax #220 manufactured by Mobil Sekiyu Kagaku K. K.) and 80 parts by weight of xylene were heated at 80° C. to dissolve the polypropylene and wax into xylene. The resulting solution was naturally cooled under agitation to precipitate the polypropylene and wax and form an emulsion containing spherical particles having a particle size of 1 to 3$\mu$. The following components were added in succession to the so formed emulsion:

| | |
|---|---|
| Styrene-butyl methacrylate resin (Himer 7300 manufactured by Sanyo Kasei K.K.) | 4 parts by weight |
| $Fe_3O_4$ (Mapico Black BL-100 manufactured by Titan Kogyo K.K.) | 72 parts by weight |
| Carbon Black (Carbon #44 manufactured by Mitsubishi Kasei K.K.) | 2 parts by weight |
| Zinc stearate (dispersant) | 0.5 part by weight |
| Xylene | 50 parts by weight |

The resulting mixture was treated for 30 minutes by a homogenizing mixer to completely dissolve and disperse the components in xylene, and the resulting composition was spray-dried to effect granulation and drying. Then, the resulting particles were dry-blended with carbon black in an amount of 0.5% by weight based on the particles, and particles having a size of 5 to 40$\mu$ were collected by classification to form a one-component type particulate developer.

An Se photosensitive plate was charged by corona discharge at +5 KV, imagewise exposed and developed with the so formed developer, and the developed image was transferred onto a plain paper and fixed in the same manner as described in Example 1. A print having a high-contrast copied image free of fog was obtained. It was found that the cleaning property of the photosensitive plate and the transfer rate of the developer were excellent. Even when 1000 prints were similarly formed, the image quality of the prints was very good.

EXAMPLE 3

In the same manner as described in Example 1, an emulsion of spherical fine particles having a size of 1 to 3μ were prepared from 12 parts by weight of low-molecular-weight polyethylene (PA 520 manufactured by Hoechst AG), 8 parts by weight of caunauba wax and 83 parts by weight of carbon tetrachloride. The so formed emulsion was added to a composition comprising 5 parts by weight of an epoxy resin (Epikote 1004 manufactured by Shell Petrochemical Inc.), 65 parts by weight of iron powder ($\gamma$-$Fe_2O_3$ B450 manufactured by Toda Kogyo K. K.), 5 parts by weight of carbon black (Vulcan XC-72 manufactured by Cabot Corp.), 0.5 part by weight of sodium dodecylbenzene-sulfonate and 60 parts by weight of acetone. The mixture was sufficiently milled in a sand mill to form a composition for spraying. The composition was spray-dried to effect granulation and drying. Then, the resulting particles were mixed with molybdenum disulfide as a flowability-improving agent in an amount of 0.5% by weight based on the particles. Particles having 5 to 40μ were collected by classification to obtain a particulate developer.

A polyvinyl carbazole-trinitrofluorenone (PVK-TNF) photosensitive plate was charged by corona discharge at +5 KV and imagewise exposed to form an electrostatic latent image, and in the same manner as in Example 2, the latent image was developed and the developed image was fixed on an offset plate having a thin barrier layer. The offset plate was etched and by using the etched offset plate, 500 prints were formed by offset printing. Each print had a sharp image and uneven application of ink was not observed. It was found that the toner image on the offset plate was completely fixed and had a very good durability.

EXAMPLE 4

The following components were sufficiently dissolved and dispersed in 50 parts by weight of toluene:

| | |
|---|---|
| Low-molecular-weight polyethylene (Highflat T-15P-2 manufactured by Gifu Shellac K.K.) dispersion in toluene | 100 parts by weight |
| Butyral resin (Slec BL-1 manufactured by Sekisui Kagaku K.K.) | 5 parts by weight |
| $\gamma$-$Fe_2O_3$ (Mapico $\gamma$-SP manufactured by Titan Kogyo K.K.) | 55 parts by weight |
| Carbon black | 1.5 parts by weight |
| Dispersant | 0.5 part by weight |

The resulting composition was spray-dried to effect granulation and drying, and particles having a size of 5 to 50μ were collected by classification. Then, the particles were dry-blended with 0.3% by weight of powdery carbon black and 0.1% by weight of powdery silica as the flowability-improving agent to obtain a particulate developer having a good flowability. A ZnO type photosensitive paper was charged and imagewise exposed, and the development was carried out by using the so obtained developer and the developed image was fixed. A print having an image of a high resolving power and free of contamination of the background was obtained. The image was excellent in the fixing property and had a high contrast. Even when 1000 prints were similarly formed, no contamination was observed in the interior of a copying machine used.

EXAMPLE 5

A composition comprising 8 parts by weight of low-molecular-weight polyethylene (Hi-Wax 110P manufactured by Mitsui Sekiyu Kagaku K. K.), 19 parts by weight of microcrystalline wax (Y-190 manufactured by Mobil Sekiyu Kagaku K. K.), 5 parts of an acrylic resin (BR-64 manufactured by Mitsubishi Rayon K. K.), 3 parts by weight of an ethylene-vinyl acetate resin (Evafluex 420 manufactured by Mitsui Sekiyu Kagaku K. K.), 72 parts by weight of $\gamma$-$Fe_3O_4$ (GF-400 manufactured by Sakai Kagaku Kogyo K. K.), 3 parts by weight of carbon black (Corax L manufactured by Degussa Co.) and 180 parts by weight of toluene was heated at 80° C., and the composition was cooled under agitation in a water bath to precipitate the wax and polyethylene in the form of emulsion particles. The cooled composition was spray-dried at room temperature, and the resulting particles were dry-blended with 0.5% of carbon black and 0.3% of hydrophobic silica as the flowability-improving agent. Particles having a size of 10 to 40μ were collected by classification to obtain a particulate developer. In the same manner as described in Example 1, an electrostatic latent image was formed on an Se plate and was developed by the so obtained developer, and the developed image was transferred onto a plain paper. A print having an image of a high contrast free of fog was obtained. Even after 1000 prints were formed in the above-mentioned manner, the image quality was very good.

EXAMPLE 6

A composition comprising 13 parts by weight of low-molecular-weight polyethylene (Hi-Wax 220 MP manufactured by Mitsui Sekiyu Kagaku K. K.), 7 parts by weight of paraffin (120F manufactured by Nippon Seiro K. K.), 0.2 part by weight of zinc stearate and 100 parts by weight of perchloroethylene was heated at 80° C. to dissolve the polyethylene and paraffin completely in perchloroethylene, and the composition was cooled under agitation in a cold water bath. When the temperature was lowered below 40° C., the polyethylene and paraffin were recrystallized in the form of a co-molten composition of both and were precipitated as emulsion particles having a spherical shape and a particle size of 1 to 3μ.

A composition for spraying was prepared by sufficiently admixing the following components to the resulting emulsion at room temperature by a homogenizing mixer:

| | |
|---|---|
| Polyester resin (Vylon #300 manufactured by Toyobo K.K.) | 10 parts by weight |
| Dye (Oil Black by manufactured by Orient Kagaku K.K.) | 3 parts by weight |
| Carbon black (Legal 400R manufactured by Cabot Corp.) | 2.5 parts by weight |
| Toluene | 50 parts by weight |

The so obtained composition was spray-dried to effect granulation and drying. Particles having 5 to 15μ were collected by classification, and 5 parts by weight of the particles were mixed with 95 parts by weight of an iron powder carrier (spherical carrier manufactured by Sinto Brator K. K.) to form a developer. An Se plate was positively charged and imagewise exposed, and the electrostatic latent image was developed by the so prepared developer and the developer image was transferred onto a plain paper. The transferred image was fixed by passing the paper between steel rolls. A print having an image free of fog with a high transfer efficiency was obtained. It was found that the cleaning property and transferability of the toner image were good. When 10000 prints were formed continuously in the same manner, reduction of the image quality was not caused and degradation of the Se drum was not observed at all. Further, the fixing property of the toner image was very good.

EXAMPLE 7

An emulsion was prepared in the same manner as described in Example 6 from 14 parts by weight of low-molecular-weight polypropylene (Viscol 550P manufactured by Sanyo Kasei K. K.), 6 parts by weight of microcrystalline wax (Wax #155 manufactured by Nippon Sekiyu K. K.) and 160 parts by weight of xylene, and the emulsion was mixed with 10 parts by weight of a polystyrene resin (Piccolastic D-125 manufactured by Pennsylvania Industrial Chemical Corp.), 3 parts by weight of a dye (Nigrosine EX manufactured by Orient Kagaku K. K.), 2 parts by weight of carbon black (Special Black IV manufactured by Degussa Co.) and 0.15 part by weight of zinc stearate (metal soap). The mixture was milled at room temperature by a sand mill, and the resulting composition was spray-dried to effect granulation and drying. Particles having a particle size of 5 to 15μ were collected by classification, and 5 parts by weight of the particles were mixed with 95 parts by weight of an iron powder carrier (EFV 200/300 manufactured by Nippon Teppun K. K.) to form a developer. The copying operation was carried out in a dry type copying machine (Copystar Model 251R manufactured by Mita Industrial Co.) by using the so prepared developer, and the developed image was pressure-fixed between steel rolls to obtain a print having a high-contrast image having a good fixing property and being free of an edge effect. It was found that the cleaning property of the master used was very excellent. Even when 1000 prints were continuously prepared, degradation of the master was not caused and prints having a high image quality were obtained stably.

EXAMPLE 8

A mixture comprising 100 parts by weight of low-molecular weight polyethylene (Highflat T-15-P-2 manufactured by Gifu Shellac K. K.; toluene dispersion having a solid content of 15% by weight), 7 parts by weight of a styrene-butadiene resin (Pliolite S-5B manufactured by Goodyear Inc.), 5 parts by weight of chlorinated polypropylene (Harden CPS-P manufactured by Toyo Kasei K. K.), 3 parts by weight of a dye (Oil Black BW manufactured by Orient Kagaku K. K.), 2.5 parts by weight of carbon black (Peerless 155 manufactured by Columbian Carbon Inc.), 0.2 part by weight of zinc stearate (metal soap) and 50 parts by weight of toluene was milled by a dispersing mill (manufactured by Asada Tekko K. K.) to dissolve the styrene-butadiene resin, chlorinated polypropylene and dye and disperse the coloring pigment to form a composition for spraying. The so formed composition was spray-dried to effect granulation and drying. Particles having a size of 5 to 15μ were collected by classification, and 5 parts by weight of the particles were mixed with 95 parts by weight of an iron powder carrier (Diaplon S-402 manufactured by Mitsubishi Kasei) to form a developer.

A PVK-TNF photosensitive plate was negatively charged and exposed through an original, and the resulting latent image was developed with the above developer. The developed image was transferred onto a plain paper and fixed under pressure by passing the paper between steel rolls. A print having a high-density image and being free of fog in the background was obtained. It was found that the cleaning property was excellent and the transfer efficiency was high. When 10000 prints were continuously formed in the above-mentioned manner, the PVK-TNF master was not contaminated at all and reduction of the image quality was not caused. Further, the resulting prints were excellent in the fixing property of the image.

COMPARATIVE EXAMPLE 1

The following components were heated at 80° C. to form a composition for spraying:

| | |
|---|---|
| Microcrystalline wax (Wax #220 manufactured by Mobil Sekiyu Kagaku K.K.) | 15 parts by weight |
| Styrene resin (Piccolastic D-100 manufactured Pennsylvania Industrial Chemical Corp.) | 3 parts by weight |
| $Fe_3O_4$ | 60 parts by weight |
| Carbon black | 2 parts by weight |
| Toluene | 140 parts by weight |

The so formed composition was directly spray-dried to effect granulation and drying, and the resulting particles were dry-blended with 0.5% by weight of carbon black. Particles having a size of 5 to 50μ were collected by classification to form a particulate developer. The copying operation was made on a plain paper by using the so prepared developer in the same manner as described in Example 1. The copied image was satisfactory in the density and fixing property, but other characteristics were insufficient. Since the so formed developer was soft as a whole, the printing resistance was 50 to 100 prints in the case of continuous printing. Further, because of blocking of the developer particles, blurring was readily caused in the copied images.

COMPARATIVE EXAMPLE 2

33 Parts of low-molecular-weight polyethylene (San-Wax 131P manufactured by Sanyo Kasei K. K.) and 65 parts by weight of $Fe_3O_4$ (Synthetic Black Iron B6 manufactured by Toyo Shikiso K. K.) were dissolved and dispersed in 180 parts by weight of hot toluene, and the resulting liquid composition was immediately spray-dried to form core particles. Then, 10 parts by weight of a styrene resin (Piccolastic D-100 manufactured by Pennsylvania Industrial Chemical Corp.) and 50 parts by weight of the so prepared core particles were dispersed in 100 parts by weight of toluene in the cold state, and the resulting dispersion was spray-dried to form microcapsulated particles comprising a core containing the wax, magnetic material and carbon black and a shell containing the polymeric substance. The so formed particles were dry-blended with 0.5% by weight of carbon black as the flowability-improving agent. Particles having a size of 5 to 40μ were collected by classification to obtain a particulate developer. By using the so prepared developer, the copying operation was carried out in the same manner as described in Example 1.

Results of the copying tests using developers prepared in Example 1 and Comparative Examples 1 and 2 are collectively shown in Table 1.

TABLE 1

| | Example 1 | Comparative Example 1 | Comparative Example 2 |
|---|---|---|---|
| Particle Structure | multi-core capsule | not capsulated | single-core capsule |
| Spray Granulation Process | one step | one step | two steps |
| Image Quality | | | |
| density | high | high | high |
| sharpness | good | good | fair |
| edge effect | not observed | not observed | observed |
| fog | not observed | not observed | observed |
| transferability | good | good | bad |
| Cleaning Property | good | good | very bad |
| Heat Resistance (stored at 60° C. for 2 hours) | good | cohesion | good |
| Blocking (during copying operation) | good | blocking and blurring occurred when 50 to 100 prints were formed | good |
| Flowability | good | bad | good |
| Printing Resistance (1000 prints) | good | bad | good |
| Fixing Property | good | good | bad |

Note
Evaluation was made by the naked eye observation at the actual copying operation test.

What we claim is:

1. A particulate composite developer for electrophotography which has a dispersion structure comprising a continuous phase consisting of a homogeneous mixture of a hard resin and a pigment and a plurality of dispersed phases consisting of spherical particles of a soft parting or fixing material having an emulsion grade size and being dispersed in the continuous phase, said resin being soluble in cold toluene, said soft parting or fixing material being selected from the group consisting of low-molecular-weight polyethylene and polypropylene and waxes, and being insoluble in cold toluene but soluble in hot toluene, said parting or fixing material (A) and said hard resin (B) being present at an (A)/(B) weight ratio of from 95/5 to 55/45.

2. The particulate composite developer of claim 1 wherein the soft parting or fixing material is a low-molecular-weight olefin resin having a penetration of 1 to 50 as measured at 25° C.

3. The particulate composite developer of claim 2 wherein the olefin resin is polyethylene or polypropylene.

4. The particulate composite developer of claim 1 wherein the soft parting or fixing material is a wax having a penetration of 1 to 50 as measures at 25° C.

5. The particulate composite developer of claim 1 wherein the resin is a hard resin having a penetration lower than 1 as measured at 25° C.

6. The particulate composite developer of claim 1 wherein said pigment is a mixture of a magnetic pigment composed of triiron tetroxide or ferric oxide and an electrically conductive pigment composed of carbon black, and the magnetic pigment and the electrically conductive pigment are present in amounts of 50 to 500% by weight and 1 to 20% by weight, respectively, based on the sum of the soft parting or fixing material and the resin.

7. The particulate composite developer of claim 6 wherein the particles have on the surfaces thereof a layer of carbon black formed by dry-blending of carbon black in an amount of 0.01 to 2% by weight based on the particles.

8. The particulate composite developer of claim 1 wherein the spherical particles of soft parting of fixing material have a particle size which is not larger than 5μ and not smaller than 0.1μ.

* * * * *